US007641351B2

(12) United States Patent
Girolami

(10) Patent No.: US 7,641,351 B2
(45) Date of Patent: Jan. 5, 2010

(54) LIGHTING BALLOON APPARATUS

(75) Inventor: Peter R. Girolami, Palisades, NY (US)

(73) Assignee: Sourcemaker, Inc., Tappan, NY (US)

( * ) Notice: Subject to any disclaimer, the term of this patent is extended or adjusted under 35 U.S.C. 154(b) by 0 days.

(21) Appl. No.: 11/767,156

(22) Filed: Jun. 22, 2007

(65) Prior Publication Data

US 2007/0297174 A1 Dec. 27, 2007

Related U.S. Application Data

(60) Provisional application No. 60/815,703, filed on Jun. 22, 2006.

(51) Int. Cl.
*F21V 33/00* (2006.01)
*F21V 29/00* (2006.01)

(52) U.S. Cl. ..... 362/96; 362/231; 362/267

(58) Field of Classification Search ..... 362/96, 362/101, 253, 189, 352, 399, 806, 154, 234, 362/240, 247, 249.05, 249.12, 267, 318, 362/231

See application file for complete search history.

(56) References Cited

U.S. PATENT DOCUMENTS

| | | | | |
|---|---|---|---|---|
| 5,102,364 | A | 4/1992 | Kubiatowicz | |
| 5,119,281 | A | 6/1992 | Akman | |
| 5,807,157 | A | 9/1998 | Penjuke | |
| 5,857,760 | A | 1/1999 | Pelton | |
| 5,861,718 | A * | 1/1999 | Pruett | 315/176 |
| 5,947,581 | A | 9/1999 | Schrimmer et al. | |
| 6,012,826 | A | 1/2000 | Chabert | |
| 6,142,415 | A | 11/2000 | Ambrico | |
| 6,146,001 | A | 11/2000 | Cwiakala | |
| 6,238,067 | B1 * | 5/2001 | Hirsch | 362/352 |
| 6,305,827 | B1 * | 10/2001 | Nolle | 362/352 |
| 6,371,638 | B1 | 4/2002 | Zingale et al. | |
| 6,966,676 | B2 | 11/2005 | Chabert et al. | |
| 7,036,958 | B2 | 5/2006 | Hayne et al. | |
| 7,077,553 | B2 | 7/2006 | Vanderschuit | |
| 7,320,529 | B2 * | 1/2008 | Goh et al. | 362/96 |
| 2005/0054262 | A1 | 3/2005 | Ma | |
| 2005/0063189 | A1 | 3/2005 | Ossolinski | |

* cited by examiner

*Primary Examiner*—John A Ward
(74) *Attorney, Agent, or Firm*—Lowenstein Sandler PC

(57) ABSTRACT

A novel lighting balloon apparatus is provided for various indoor and outdoor lighting applications. The lighting balloon apparatus is comprised of a unique rectangular-shaped balloon envelope body constructed from a medium weight laminate of polyester film weaved into polyester fabric using an adhesive containing an antimicrobial additive and an ultraviolet inhibitor. The rectangular-shaped body of the balloon envelope provides a means for controlling the emission of light by allowing for the accommodation of lightweight taffeta panels without compromising control. The lighting balloon apparatus is further configured to accommodate multiple lighting sources, as well as applicable mixtures thereof. The various lighting sources that may be employed are securely coupled to a harness assembly suspended within the body center of the balloon envelope structure, which is sealed with a helium tight cap system and coupled to a relay bypass system for regulating multiple lighting source socket arrangements.

10 Claims, 6 Drawing Sheets

LIGHTING BALLOON APPARATUS

CROSS-REFERENCE TO RELATED APPLICATIONS

The present application claims the benefit of U.S. Provisional Patent Application No. 60/815,703, filed Jun. 22, 2006, which is hereby incorporated by reference in its entirety.

BACKGROUND OF THE INVENTION

1. Field of the Invention

The present invention relates to lighting balloons. More particularly, the present invention is directed to a lighting balloon apparatus configured to employ multiple lighting sources and mixtures thereof, while providing a stable and resilient illuminating body that may accommodate desired fixtures thereon.

2. Description of the Related Art

There is an increasing demand for the use of lighting balloons, particularly in the entertainment industry, due to their ability to provide various illuminations in a sensitive location lacking requisite lighting. The preference for lighting balloons is primarily attributed to their ease of use for required daytime and nighttime illumination, as well as for their applications in exterior and interior locations.

Lighting balloons found today are typically spherical-shaped and composed of rip stop or sailcloth materials coated with a polyurethane, which in many cases limits the range of lighting output. Over time, the potential illumination provided by these balloons are prone to fading due to discoloration of the light emitting material (hereinafter "the balloon envelope"). For example, the urethane coating used to seal conventional balloon envelopes has been known to chemically deteriorate as a result of sustained exposure to various lighting sources, resulting in the surface of the balloon envelope turning into an undesirable yellowish-stained shade. This discoloration inevitably shifts the intended color temperature expected from a particular lighting source, thereby frequently prompting the need to replace the balloon envelope in order to regain the desired lighting output.

Lighting balloons may be tailored to provide a soft quality of light, capable of illuminating 360 degrees from the light source. In many cases, however, 360 degrees of illumination may not be desirable and, therefore, there are instances where there is a need to control the illumination emitted from the balloon envelope. As the popularity of lighting balloons grow so do the demands of lighting professionals to have them designed to yield various desired looks and uses. Unfortunately, the illuminating direction of conventional lighting balloons are difficult to control. The difficulty associated with controlling these lighting balloons is mainly attributed to the curvature and seams associated with the commonly used spherical-shaped balloon envelope. For example, in an attempt to control the illumination emitted by such balloons, lighting designers have been known to add black tarp-like materials onto the surface of the balloon envelope to block light. However, this typically does not achieve the desired result, but rather results in the body of the spherical-shaped balloon envelope to roll in the direction of the weight added, only to further alter the desired direction of lighting output.

There was a time when most locations were able to accommodate lighting balloons that simply emitted day light (i.e., a color temperature of 5500 Kelvin) and tungsten light (i.e., a color temperature of 3200 Kelvin) without worry of mismatching in the color temperature of lighting sources. However, today's professionals encounter many challenges due to the various lighting sources that are now more frequently utilized, such as sodium vapor lighting used to illuminate roads at night and metal halide and mercury vapor lighting that is typically found in industrial areas and stadiums. There exists a desire, particularly in the filming community, to have the color temperature of light emitted by balloon envelopes match the color temperature of light emitted by fixed illuminating structures found in various locations. For example, when legacy film lighting instruments are utilized by professionals in the filming community, the light emitted by these legacy instruments need to be recolored in final production to match the pre-existing lighting captured in various scenes, thereby unnecessarily increasing the costs in producing such films. Although conventional lighting balloons have improved over time by providing for multiple source lighting, they continue to lack in meeting the increasing demands of those industries commonly requiring the use of such lighting structures. Conventional lighting balloons, in providing multiple source lighting, typically require the use of multiple lighting balloons structures and harnesses or, alternatively, the use of colored sleeves that need to be assembled onto lighting fixtures prior to inflation. These conventional means are severely deficient in that the use of additional lighting structures and components are costly, while sacrificing the lightweight maneuverability and power consumption benefits associated with earlier lighting balloons.

Accordingly, there exists a need in the art for a reliable and resilient lighting balloon apparatus configured to employ multi-faceted ambient light sources.

SUMMARY OF THE INVENTION

In view of the foregoing, it is an object of the present invention to provide a lighting balloon apparatus having a balloon envelope composed of a material that is robust and resilient to deterioration and discoloration, thereby providing a means for emitting light at a sustained color temperature.

It is another object of the present invention to provide a lighting balloon apparatus having an improved balloon envelope body, thereby providing a means for controlling the intensity and direction of light emissions, as well as the overall stability of the balloon envelope structure.

It is yet another object of the present invention to provide a lighting balloon apparatus configured to accommodate a plurality of lighting sources to match light emitted by fixed illuminating structures in various locations, as well as to simplify the process of adjusting the desired lighting output, thereby eliminating the need for inefficient lighting modifications and significantly reducing the costs associated with such procedures.

These and other objects are accomplished in accordance with the principles of the present invention by providing an improved lighting balloon apparatus. The lighting balloon apparatus of the present invention employs the use of a novel rectangular-shaped balloon envelope, rather than a spherical or cylindrical shape as typically employed in conventional lighting balloons. The sides making up the body of the rectangular-shaped balloon envelope may be equipped with Velcro® or any other applicable fastening device to allow for the attachment of a black, lightweight skirting material serving as a means for completely blocking or adjusting the intensity of any light-emitting portion of the balloon envelope body, thereby creating a desired lighting effect without compromising the stability of the balloon envelope structure. Additionally, advertising materials, various decorative attachments, decals, digital print work and video projection capabilities may be affixed more easily due to the rectangular-shaped side panels composing the body of the balloon envelope. The rectangular shape of the balloon envelope also provides for increased aerodynamic control over conventional curved body structures in that it allows the body of the balloon envelope to remain better squared to a surface. Nylon loops are also attached at the corners of the balloon envelope body to control positioning of the balloon envelope, as well as to provide safety rigging points.

The lighting balloon envelope of the present invention is made from a medium weight laminate of polyester film weaved into polyester fabric using an adhesive containing antimicrobial additives and ultraviolet inhibitors to reduce, respectively, the incidence of mildew and discoloration. This new balloon envelope material is stronger than materials used in the past, and is very effective in providing protection from harmful ultraviolet exposure. Therefore, the light emitting body of the balloon envelope is kept as white and as clean as possible, unlike other materials that commonly turn yellow and result in a warmer lighting source that is highly undesirable. The top portion of the new balloon envelope is also preferably lined or coated with a highly reflective material, thereby significantly increasing the lighting output capabilities of the balloon envelope body.

The lighting balloon apparatus of the present invention may be configured for a combination of different lighting sources, all coupled to a single harness assembly suspended within the body center of the balloon envelope. The harness assembly is structured to provide a means for affixing multiple lighting fixtures (e.g., three fixture pairs having opposing sockets), some of which are powered by a combination of step-up transformers and high voltage igniters. Additionally, the lighting fixtures may be wired in a manner so as to allow for different lighting sources to be interchanged using the same lighting fixture. Lighting fixtures are configured, for example, to accommodate various combinations of HMI and tungsten bulbs, thereby creating many color illumination options with temperatures ranging from 3200 to 5500 Kelvin.

In another embodiment, the lighting balloon apparatus of the present invention may be configured for a single lighting source of a particular type, such as sodium vapor, metal halide or mercury vapor lighting sources, allowing for prefixed lighting sources present at various locations to be easily matched. Similarly, these various lighting sources are suspended within the body center of the balloon envelope through the use of various caps and springs coupled together in a particular harnessing arrangement. However, a rigid-mount configuration may also be made available for high wind conditions, and can be easily mounted to tripods or other standard rigging hardware. Lighting sources employed in the balloon envelope of the present invention are ultimately controlled by a relay power distribution system coupled to the aforementioned harness configurations.

BRIEF DESCRIPTION OF THE DRAWINGS

Objects and advantage of the present invention will become apparent upon consideration of the following detailed description, taken in conjunction with the accompanying drawings, in which like reference characters refer to like parts throughout, and in which.

It is to be understood that the abovementioned drawing figures are provided solely to assist in describing the concepts of the present invention and may not be to scale, and are certainly not intended to be limiting in terms of the range of possible shapes and proportions well within the scope of the present invention.

DETAILED DESCRIPTION OF THE PREFERRED EMBODIMENTS

The present invention is directed towards a novel lighting balloon apparatus that is robust in construction, easy to control and configured for providing a plurality of desired illumination outputs. For purposes of clarity, and not by way of limitation, illustrative depictions of the present invention are described with references being made to the above-identified drawing figures. Various modifications obvious to one skilled in the art are deemed to be within the spirit and scope of the present invention.

Figure 1:
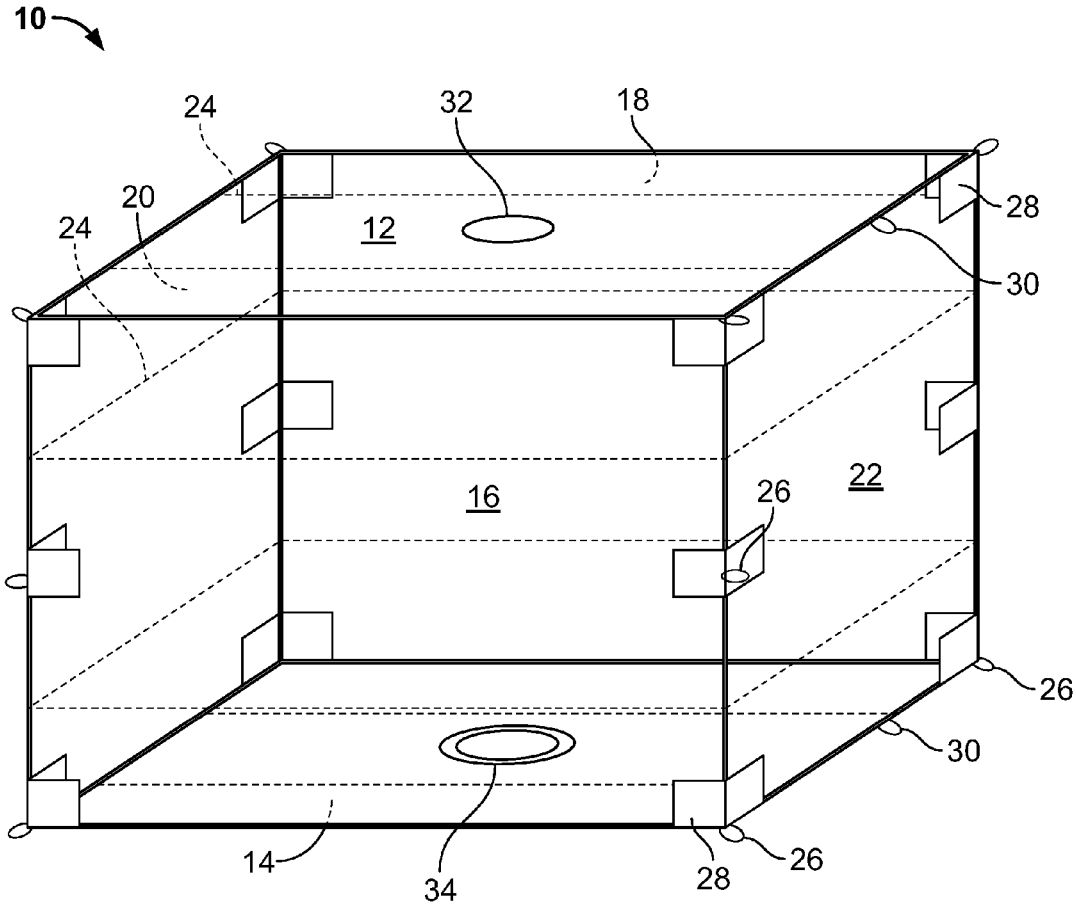
FIG. 1 provides for an illustrative perspective view of a balloon envelope employed in accordance with a preferred embodiment of the lighting balloon apparatus of the present invention.

The lighting balloon apparatus of the present invention employs a rectangular-shaped illuminating body, said rectangular-shaped illuminating body being referred to herein as the balloon envelope. An exemplary balloon envelope 10 employed in a preferred embodiment of the present invention is illustrated in FIG. 1. Balloon envelope 10 is constructed having six orthogonally-fixated sides comprising a top portion 12, a base portion 14, a front portion 16, a back portion 18 and two side portions 20 and 22. The body of balloon envelope 10 is preferably composed of a material having a medium weight laminate of polyester film weaved into polyester fabric using an adhesive containing an antimicrobial additive, to reduce the incidence of mildew, and an ultraviolet (UV) inhibitor. This resilient material may be cut into various sized templates and sewn together using double sided adhesive tape, also preferably treated with a UV inhibitor. Seams 24 may then be sealed using a 2" Mylar® adhesive tape, or any other durable adhesive, overlaid along the surface of the stitched area and compressed with a rolling mechanism. Thereafter, a 4" Mylar® adhesive tape, or another suitable adhesive alternative, may be applied thereon as a secondary layer for sealing seams 24. Additionally, a reflective material (not shown) may be sewn to the interior surface area of top portion 12 to direct, as well as increase, the illuminating output generated by a lighting source suspended within the gas-filled void of balloon envelope 10.

Tubular mesh webbing may be sewn together, forming one inch loops 26 at corners or along edges of balloon envelope 10, to provide rigging points for controlling the position of balloon envelope 10 or, alternatively, to provide rigging flexibility when connecting more than one balloon envelope 10 together. Loops 26 may be, for example, nylon loops sewn to patches 28, which are comprised of a strong textile fiber, such as Dacron®, affixed along the corners of balloon envelope 10. Additionally, Velcro® loops 30 may be provided along any of the edges of balloon envelope portions 14-22 to allow for attachment of various shielding panels, advertisements or other suitable materials. For example, lightweight black taffeta panels (not shown) matching the dimensions of side portion 22 may be attached using Velcro® loops 30 to serve as a means for changing the direction or intensity of light emitted from balloon envelope 10, or simply for aesthetic purposes to create a desired ambience for a particular event. Attaching lightweight fabric panels to any of balloon envelope portions 14-22 is the preferred means for blocking, redirecting or absorbing light in that they do not unnecessarily shift or tip the desired illuminating direction of balloon envelope 10.

Balloon envelope 10 is further comprised of a top cap 32, which may be positioned and affixed to the center of top portion 12 with screws and silicone. Top cap 32 may include a receiver ring containing stainless steel shackles to provide a stable core for suspending various lighting assemblies (described in further detail in connection with the illustrations provided in FIGS. 2, 4 and 5). Additionally, two plastic receiver rings 34 may be positioned in the corresponding opposing center of base portion 14 of balloon envelope 10, which when affixed completely seals the gas-filled void of balloon envelope 10.

Figure 2A:
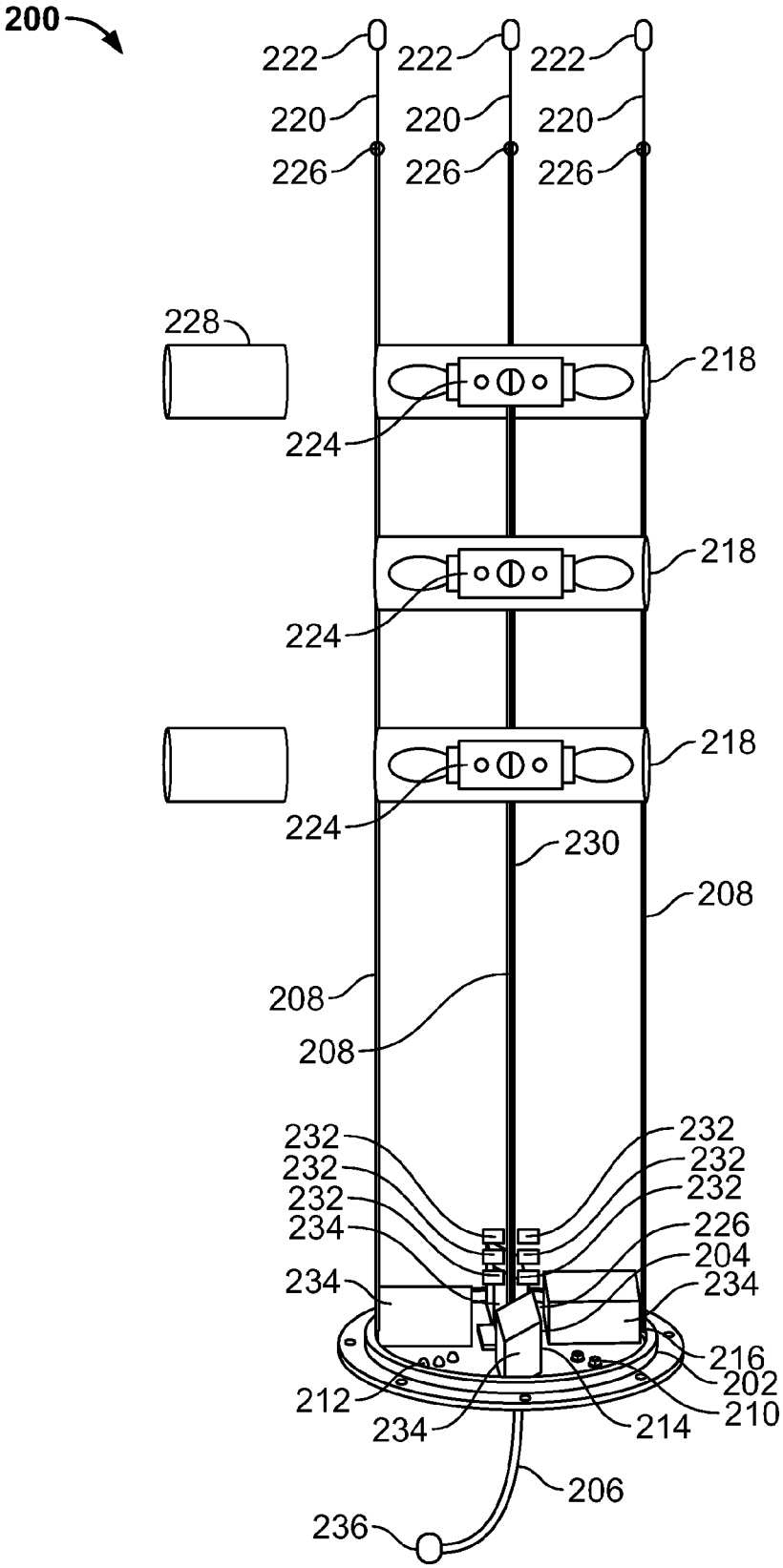
FIGS. 2A and 2B provide for illustrative perspective views of a harness assembly configured to accommodate a combination of different lighting sources and suspended within the body center of the balloon envelope of the present invention.
Figure 2B:
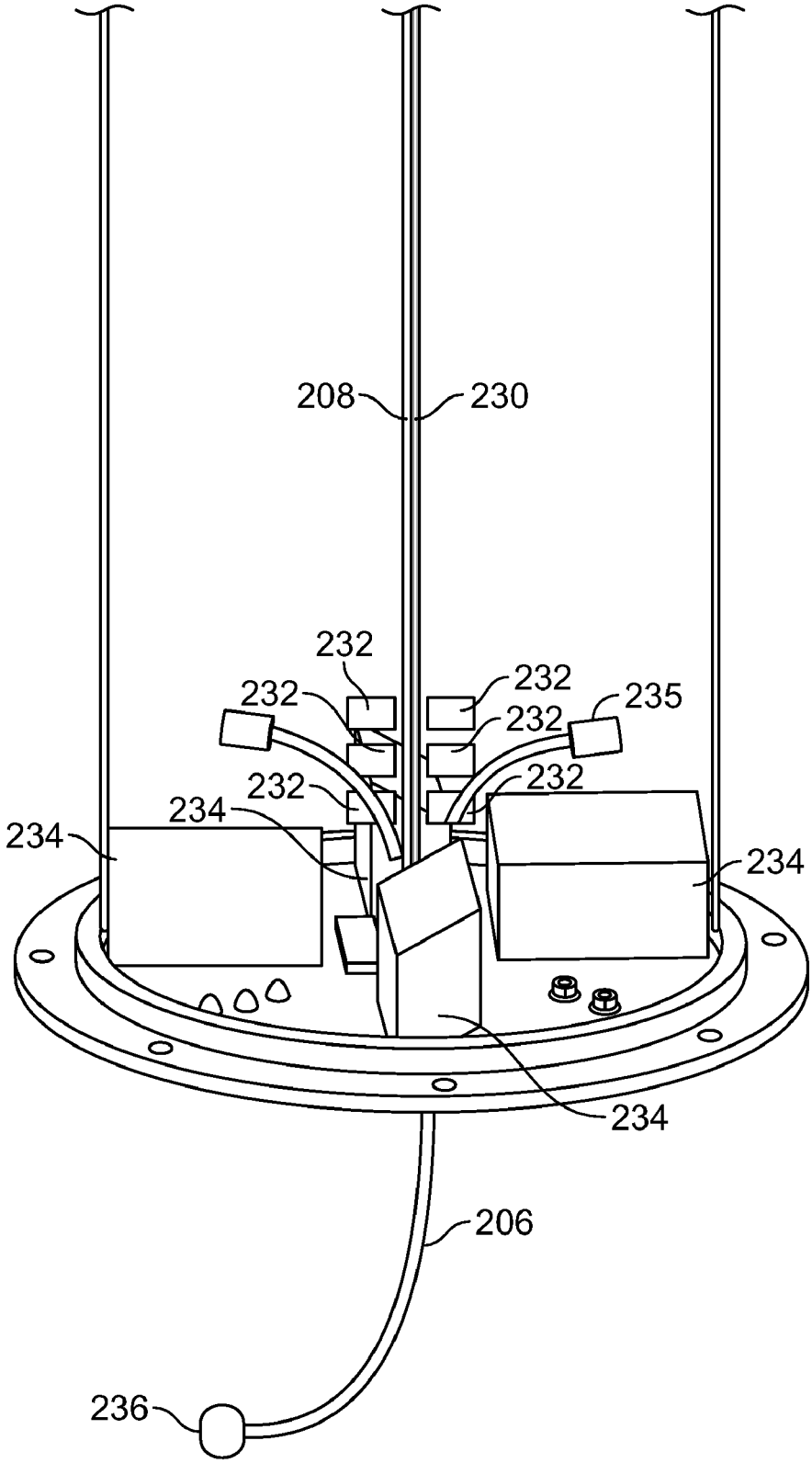

An exemplary lighting balloon harness assembly 200 is illustrated in FIGS. 2A and 2B. Harness assembly 200 is configured in a manner to allow it to be securely suspended in the body center of the gas-filled void of balloon envelope 10 and, additionally, is further configured to accommodate a plurality of different lighting sources on its single body structure. For example, HMI and tungsten lighting sources may be used in the lighting balloon apparatus of the present invention. However, although the HMI and tungsten bulbs have the same bi-post base allowing them to be easily interchanged, they are powered differently. HMI bulbs are powered by a step up transformer and a high voltage igniter system, while tungsten bulbs are powered, for example, by a 220V alternating current source. Therefore, it is preferable to design a harness assembly so that multiple power sources may be interchanged while the lighting balloon apparatus of the present invention is in use.

Harness assembly 200 illustrated in FIGS. 2A and 2B is designed to accommodate a six socket arrangement, wherein three affixed lamp fixtures having paired socket ends 224 are provided so that two bulbs are back to back and counter balanced along the single body structure of harness assembly 200. This particular configuration allows for paired bulbs to be evenly suspended from the center position of balloon envelope 10. However, it should be noted that harness assembly 20 is provided as an example to illustrate the present invention and is not necessarily limited to the use of three evenly spaced lamp fixtures having paired socket ends 224. It is well within the scope of the present invention to envision the use of alternative lamp fixture arrangements in connection with harness assembly 200. For instance, it may be possible to design harness assembly 200 so that it may accommodate twelve bulbs. The twelve bulbs may be used, for example, by providing three evenly spaced lamp fixtures having quad-ended socket arrangements, wherein the four sockets provided on each of the three lamp fixtures are evenly spaced and counterbalanced by arranging each lamp socket orthogonally to the neighboring lamp socket.

Harness assembly 200 is comprised of a base cap 202 at its end, which is received by rings 34 fixated at the center of base portion 14 of balloon envelope 10. Base cap 202 may be constructed having an o-ring portion to provide a secure seal against base portion 14 of balloon envelope 10, as well as to provide a platform for mounting a number of various lighting accessories. A cable restrainer 204 is mounted through an aperture located at the center of cap 202 and may be secured through use of a clevis pin assembly, thereby providing a means for a multi-conductor cable 206 to be passed through cap 202 into balloon envelope 10 without compromising the air tight seal. This also serves as a point for attaching a center steel cable shroud 208. Pneumatic air fittings 210 having male threaded ends are received by corresponding female threaded holes provided in cap 202 to provide filler valves for inflating balloon envelope 10. Release valves 212, set at 0.5 psi or any other suitable pressure release measurement, are mounted into pressure fitted apertures provided in cap 202. A one way air valve 214 (e.g., a Boston valve) may also be mounted through an aperture in cap 202.

Two steel cable shrouds 208 are attached to two corresponding eye bolts 216 mounted at opposing sides near the perimeter of cap 202. Perimeter cable shrouds 208 are extended through aluminum mesh filter holders 218 to springs 220 having steel clips 222 at their ends to be attached to top cap 32, which is affixed at the center of top portion 12 of balloon envelope 10. Center steel shroud 208 is attached to clevis pin assembly 204 at the base end and is extended through Teflon® dual bi-post multi-source lamp sockets 224 to center spring 220 having at least one steel clip 222 for attaching to top cap 32. Nico press sleeves 226 may be used and crimped to make loops on all the ends of steel cable shrouds 208, providing a means for attaching springs 220 and steel clips 222 to the shackles of top cap 32. Springs 220 serve to provide shock absorption when coupled to shrouds 208 and suspended from top cap 32 via steel clips 222.

Aluminum mesh filter holders 218 may be provided in a cylindrical shape with Teflon® rollers, and are configured to accommodate mounting of cylindrically-shaped, UV and color temperature protected, high heat glass filters 228. Aluminum mesh filter holders 218 are mounted to lamp fixtures having paired socket ends 224. Lamp fixtures having paired socket ends 224 may be multi-source lamp fixtures, as previously described, comprised of brass socket connection sleeves, or any other durable material, threaded to receive center steel shroud 208 set by crimped nico press sleeve 226.

High heat, high voltage ignition wires 230 are connected to each of multi-source socket ends 224 using lock tight set screws, or any other suitable hardware for safely securing ignition wires 230 to corresponding socket ends 224. Some or all of ignition wires 230, depending on the number of sockets employed and the desired lighting capabilities, may include multi-source bypass connectors 232, thereby providing a means for bypassing high voltage igniters 234 or any other applicable lighting device that may be employed at the opposing ends of ignition wires 230. Igniters 234, ranging from 1200 W to 6000 W, may be mounted on base cap 202 and have opposing bypass connectors 235 for connecting to corresponding bypass connectors 232. For example, harness assembly 200 may utilize four 4000 W HMI igniters 234 to power four 4000 W HMI bulbs, wherein HMI igniters 234 are connected via high voltage ignition wire 230 to corresponding socket ends 224 having the 4000 W HMI bulbs. Similarly, any one of these HMI igniters 234 may be bypassed if a connector 232, coupled to an ignition wire 230, and a connector 235, coupled to an igniter 234, are joined together, thereby allowing a bulb in the corresponding socket end 234 that does not require the use of igniter 234 to be powered accordingly.

However, it is important to note that the present invention is not limited to the use of four HMI igniters as described in the preceding example. Any number and combination of igniters 234 or, as previously mentioned, any other suitable combination of lighting devices may be used to power a variety of bulbs suspended from harness assembly 200. Additionally, these plurality of igniters 234 or various combinations thereof may include bypass connectors 235 at both input and output ends of their units to be optionally connected to bypass connectors 232 coupled to ignition wires 230 leading to paired socket ends 224 of corresponding lamp fixtures. The inclusion of bypass connectors coupled appropriately to lighting components in harness assembly 200, thus, provide a means for allowing both HMI and tungsten bulbs having the same mount (or other similarly mounted bulbs) to be used interchangeably in the lighting balloon apparatus of the present invention.

Figure 3:
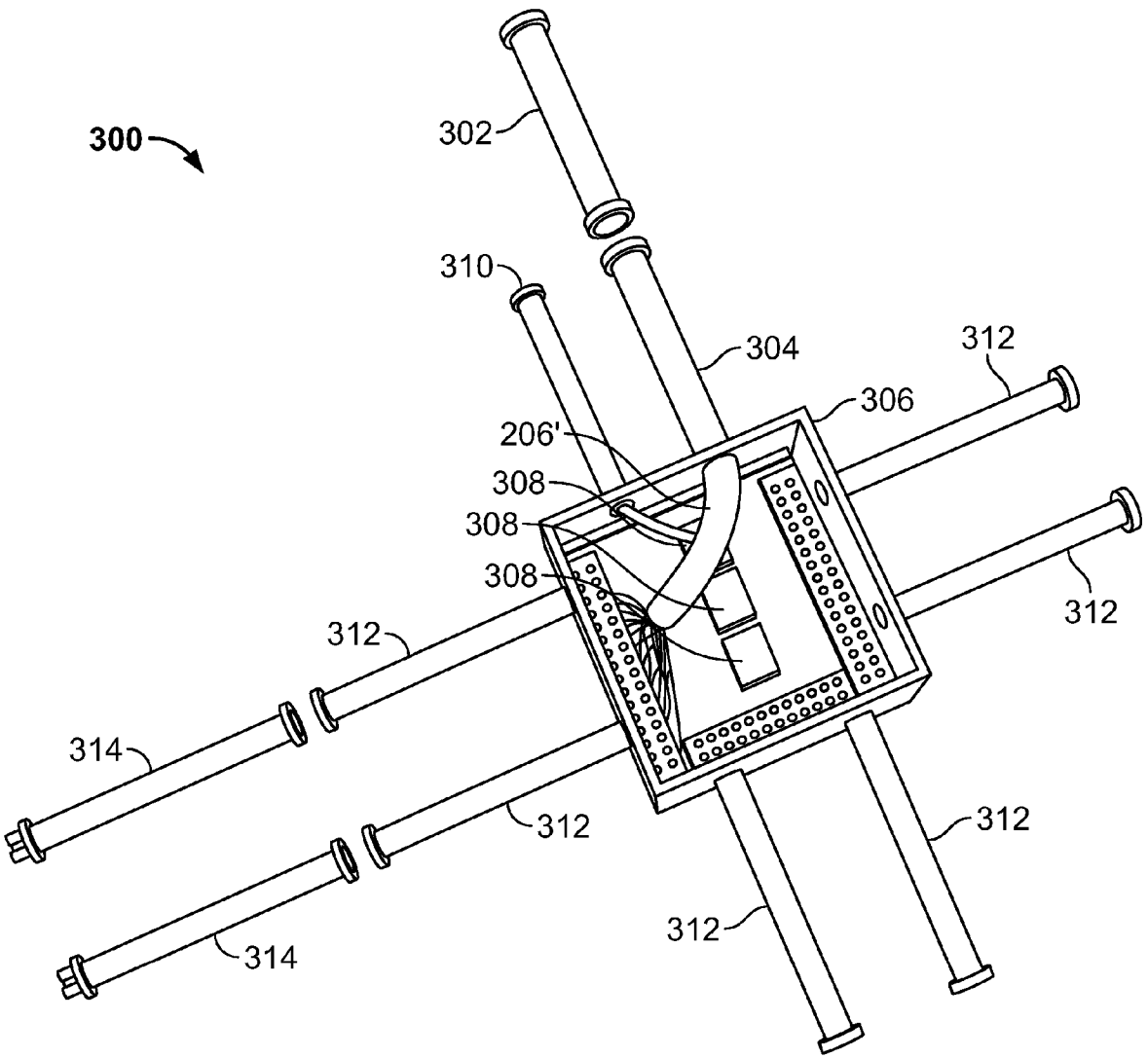
FIG. 3 provides for an illustrative perspective view of a multi-source safety relay power distribution system coupled to the harness assembly of the present invention.

Multi-conductor cable 206, passing thru cable restrainer 204, is therefore capable of employing separate circuit arrangements with the application of bypass connectors 232 and 235, providing a means to feed high voltage igniters 234 or to bypass them and connect directly to ignition wires 230. Multi-conductor cable 206 is extended out of base cap 202 and provided with a socopex connector 236 at its end for connecting to an external power source. Socopex connectors are typically employed in multi-cable arrangements, such as that of multi-conductor cable 206, for delivering independent and likely different circuits of power, all conveniently bundled together in one insulated jacket. Multi-conductor cable 206 may be connected to a power distribution system 300, as illustrated in FIG. 3, via a multi-connector cable 302. Multi-connector cable 302 is preferably an elongated multi-connector cable (e.g. a 120' extension cable), which is connected at one end to socopex connector 236 of multi-conductor cable 206 and at the other end to a power distribution box 306.

Power distribution box 306 may be comprised of a plurality of safety relays 308 to protect against inadvertent coupling of bulbs and the various power sources feeding multi-source lamp sockets ends 224. Safety relays 308 are independently powered by a separate 110V power source via a hubble plug 310, which must be energized to activate power distribution system 300. Multi-conductor cable 206', coupled to multi-conductor cable 206 via multi-connector cable 302, is appropriately connected to the arrangement of safety relays 308 housed within power distribution box 306 and is sealed accordingly with the use of water tight restrainers 304.

Relays 308 may be configured to receive a signal in order to determine whether corresponding igniters 234 are plugged into power distribution system 300, thereby enabling a user with the option to bypass the system. Alternatively, when igniters 234 are unplugged and corresponding ignition wires 230 are directly plugged into the system via multi-conductor cable 206, no signal is transmitted and relays 308 remain in bypass mode. The bypass mode enables the user to employ, for example, either 5000 W tungsten bulbs or, if the relay switch is enabled, 4000 W HMI bulbs, as described earlier in connection with the harness assembly arrangement illustrated in FIGS. 2A and 2B.

Veam connectors may be provides at the ends of multi-conductor cables 312, extending out of power distribution box 306, to allow for connections to corresponding step-up transformers (not shown), wherein the transformers are employed to transmit the appropriate power to each of the socket ends 224 affixed to harness assembly 200. Step-up transformers may be equipped with a safety loop circuit system coupled to relays 308, which switches on to allow high voltage to reach igniters 234. However, when bypass connectors 232 are connected and igniters 234 are unplugged, safety relays 308 do not switch on and the aforementioned safety loop circuit is not needed. Rather, 220V is used to power the tungsten bulbs with out the safety loop circuit, which may be protected with the use of an independent 220V dimmer and breaker switch. Six multi-conductor cable pigtails 312 may be used to separate each of the six socket end applications illustrated in FIG. 2B, four of which may be connected to HMI transformers and wherein two of those four are further connected to the relay system of power distribution system 300. When relays 308 are in bypass mode, as previously described, a short multi-conductor cable adaptor 314, having an opposing veam connector at one end and a 220V, 30 amp twist lock connector at the other end, may be used to adapt the high voltage HMI system to the 220V tungsten bulb system. Adaptor 314 can be used on any multi-conductor cable lead 312 to convert from HMI to tungsten. Conversely, the use of adaptor 314 is not necessary when corresponding igniter 234 is plugged into the system and relays 308 are switched on. In this case the corresponding cable pigtail is plugged directly into the HMI transformer for powering the 4000 W HMI bulb.

The aforementioned system, when employed in the lighting balloon apparatus of the present invention, may provide lighting professionals with a plurality of color options having temperatures ranging from 3200 Kelvin (tungsten) to 5500 Kelvin (daylight). For example, using the harness assembly illustrated in FIGS. 2A and 2B, lighting professionals may choose to employ the use of four HMI bulbs, four HMI and two tungsten bulbs, three HMI and three tungsten bulbs, two HMI and four tungsten bulbs, four HMI bulbs with full color temperature orange (CTO) filters along with two tungsten bulbs, one HMI bulb with full CTO filter along with three HMI and two tungsten bulbs or any other suitable combinations thereof. Configuring lighting balloons with an ability to mix lighting sources within the same balloon envelope body provides lighting professionals with the ability to change the color temperature of the balloon efficiently. This is particularly beneficial during film making where light intensity is crucial. Absent the ability to add and subtract colors, the height of the lighting balloon would have to be consistently adjusted to control the illumination intensity being output.

Figure 4:
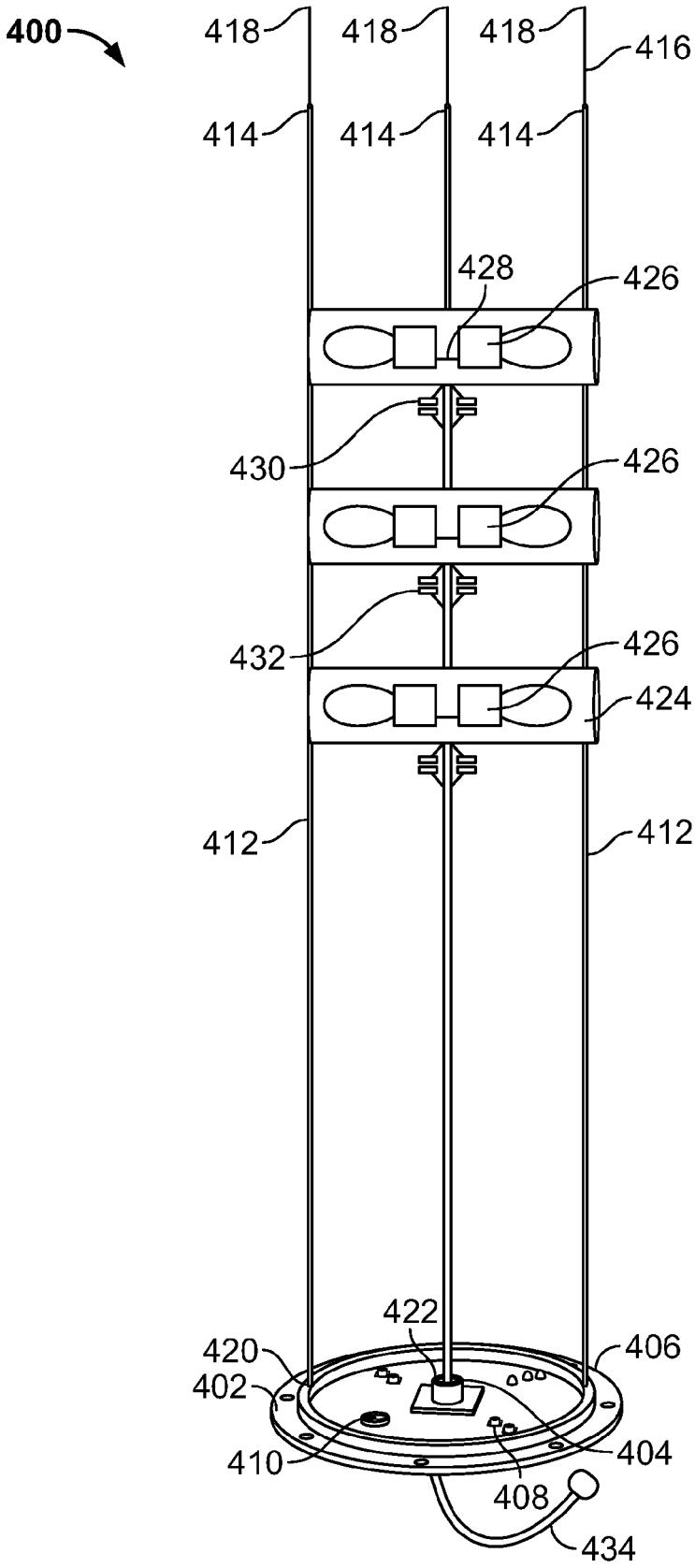
FIG. 4 provides for an illustrative perspective view of another harness assembly configured to accommodate multiple lighting sources in accordance with an embodiment of the present invention.
Figure 5:
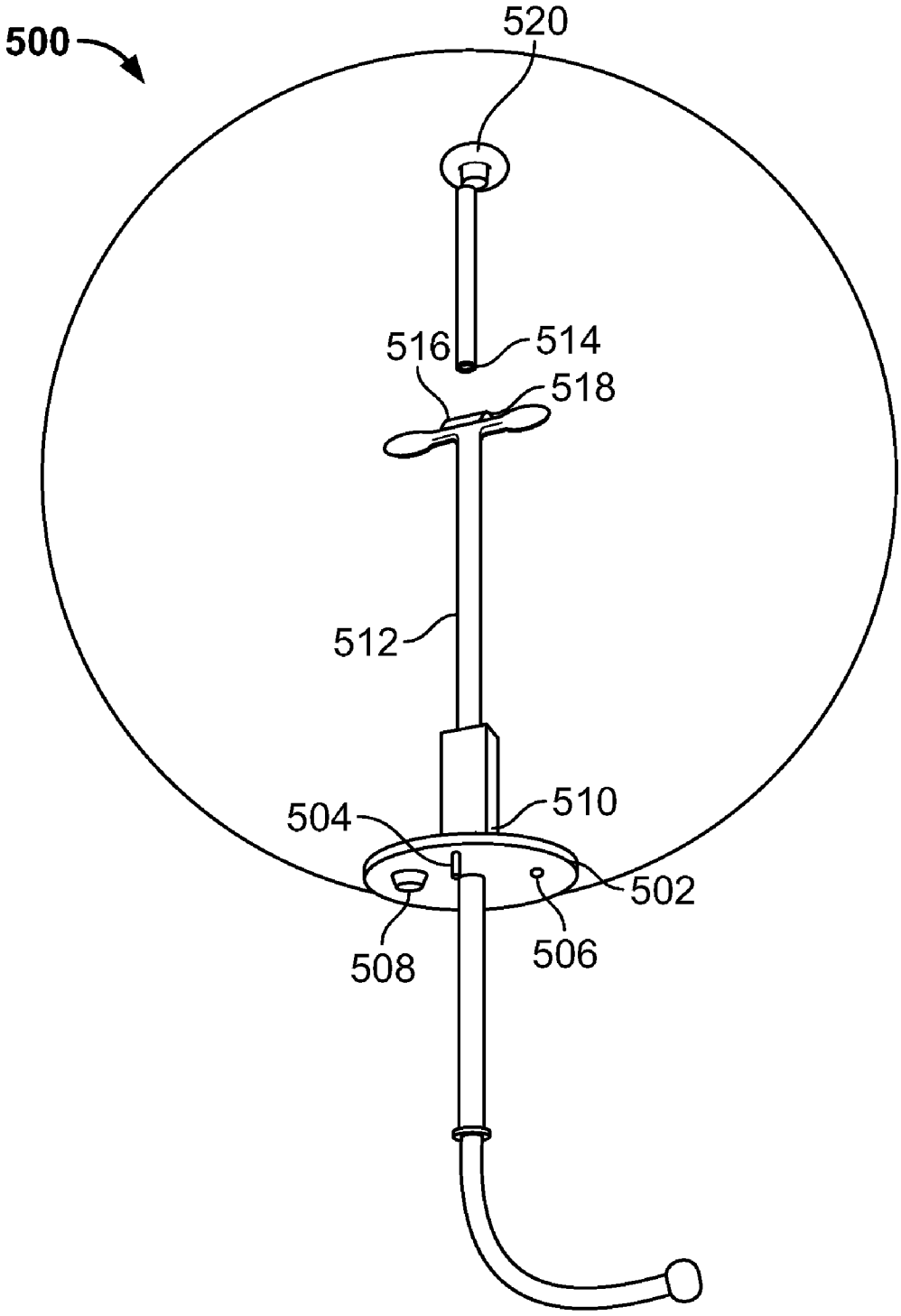
FIG. 5 provides for an illustrative perspective view of a rigid mount harness assembly employed in accordance with an embodiment of the present invention.

In an alternative embodiment, harness assembly 400 of FIG. 4 may be provided for use with sodium vapor, mercury vapor, metal halide and other lighting sources commonly found in many of today's various outdoor locations (e.g., stadiums, streets and industrial areas). Harness assembly 400 is similarly configured, for the most part, to earlier described harness assembly 200 illustrated in FIGS. 2A and 2B. However, unlike harness assembly 200, harness assembly 400 does not have igniters or ballast boxes affixed to its base, but rather they may be provided externally from the lighting balloon envelope. Harness assembly 400 is comprised of a base cap 402 having an o-ring, a clevis pin assembly 204, pneumatic air fittings 406, plastic release valves 408 and a one way Boston valve 410, which may all be utilized in the design of various multi-source units having the same intended use as described in connection with the lighting balloon apparatus of the present invention. Harness assembly 400 is further comprised of suspension hardware, again similar to those previously described, such as steel shrouds 412, nico press sleeves 414, springs 416, steel clips 418, eye bolts 420, cable restrainer 422 and aluminum mesh filter holders 424.

Aluminum mount plates 428 may be provided for attaching mogul based sockets 426, wherein sockets 426 are paired and mounted in opposing directions. A hole is provided through the center of mount plates 428 so that a shroud may be passed through, preferably threaded with a steel braided cable, to securely suspend harness assembly 400 within the center body of the balloon envelope. Nico press sleeves 414 may be used to secure mount plates 428 to the center steel cable shroud, which itself is secured at its end to base cap 402. Sockets 426 and mount plates 428 may be mounted in succession along the center steel cable shroud, as depicted, or in an alternative formation, depending on the balloon envelope size and light intensity output required.

Male quick release connectors 430 may be added to wiring leads coupled to sockets 426. Corresponding female quick release connectors 432 may be added to a multi-conductor cable 434 received and secured by cable restrainer 422, and extending to the electrical receiving ends of sockets 426. Quick release connectors 430 and 432 may be selectively coupled together to allow for various power bypassing schemes, similar to those previously described. An elongated multi-conductor cable (not shown) may be provided and extended from the plug end of multi-conductor cable 434 exiting base cap 402 to be received by transformers and igniters, provided at a location remote from the balloon envelope body, needed to power the particular bulb or bulbs being employed in sockets 426. The transformers and igniters may be, for example, provided in a ballast type enclosure having a 110V Edison plug at one end, for receiving an electrical feed, and a twist lock 20 amp plug at its other end of transmitting the transformed electrical feed. When the twist lock plug of the enclosure receives the power plug provided at the end of multi-conductor cable 434, sockets 426 of harness assembly 400 are powered accordingly.

In yet another embodiment, a rigid mount design may be employed for use in the lighting balloon apparatus of the present invention. Such a design is exemplified in rigid mount assembly 500 of FIG. 5, wherein assembly 500 is constructed similarly to harness assemblies 200 and 400 illustrated, respectively, in FIGS. 2A-2B and 4. Assembly 500 is comprised of a base cap 502 having an o-ring, pneumatic air fittings 504, plastic release valves 506 and one way Boston valve 508. Here, a cable restrainer 510 is provided without the need for a clevis pin assembly, as previously described in connection with assemblies 200 and 400. Instead, the previously described clevis pin assembly is replaced with a nut assembly, which may be used to fasten and clamp cable restrainer 510 to base cap 502.

An aluminum tube 512 is extended through cable restrainer 510 to a desired length, depending on the illumination output of the bulb or bulbs, and threaded internally to accept an extension 514 for reaching the top of the balloon envelope employed in the rigid mount design. The portion of aluminum tube 512 extending out of base cap 502 provides a means for entertainment-pertaining hardware to be attached for stand mounting or other similarly situated rigging mounts. Aluminum tube 512 may be further threaded along its outside surface in proximity to base cap 502 for use with cable restrainer 510, which has internal threads for accepting the threaded end of aluminum tube 512. Cable restrainer 510 is configured so as to allow multi-conductor cables necessary for feeding tungsten and high voltage HMI units to pass through the inside of aluminum tube 512, while at the same time insuring an air tight seal. Holes may be machined in aluminum tube 512 to feed cables through to socket leads, wherein connections are made with high heat crimps pulled back into aluminum tube 512.

Tungsten units may be assembled using sliding bulb mounts moved into the proper position and fastened with a set screw. For example, sliding bulb mounts may be utilized for affixing lamp holder mount 516. In HMI units, a threaded mounting plate may be attached to the top of aluminum tube 512, thereby allowing high heat Teflon bi-post sockets 518 to be used. In the HMI design an aluminum mesh filter holder (as previously described in conjunction with FIG. 4) may be attached to sockets 518 to provide protection from UV emissions and to control color temperature changes. Sodium vapor, metal halide and mercury vapor units may employ a similar threaded mounting plate called a vapor mounting plate, which is designed to accept a mogul based socket (as previously described in conjunction with FIG. 4). These various lighting source units may further utilize a balloon support structure referred to as a harp. The harp may be constructed with four aluminum tubes and internally threaded at one end to be screwed onto base cap 502, wherein the four aluminum tubes may be heated and bent towards each other so they meet at a center point. At the center point, aluminum tub 512 may then be welded thereto and extended vertically to the desired length matching the balloon envelope height, being received by a removable Teflon receiver cap 520.

One skilled in the art will appreciate that the present invention can be practiced by other than the described embodiments, which are presented for purposes of illustration and not by way of limitation. Various arrangements of the described embodiments can be made by those skilled in the art without departing from the spirit and scope of the present invention, which is limited only by the claims that follow.

What is claimed is:

1. A lighting balloon apparatus, comprising:

a single balloon envelope body forming an enclosed space and adapted for retaining a gas therein, said single balloon envelope body having a plurality of rigging points along its exterior surface;

a harness assembly suspended within said enclosed space, secured between a top center portion and a bottom center portion of said single balloon envelope body, having a plurality of lighting fixtures affixed thereto, wherein said plurality of lighting fixtures are configured for receiving a plurality of different lighting sources, wherein said plurality of lighting fixtures are coupled to at least two different lighting sources, and wherein said at least two different lighting sources have disparate powering requirements and emit different color temperatures of light;

a multi-conductor cable, said multi-conductor cable having at least one conductive power lead coupled to a receiving end of at least one of said lighting fixtures; and a power distribution source, wherein said power distribution source is configured to drive said at least two different lighting sources by transmitting at least one electrical signal via said multi-conductor cable to be received by said receiving end of at least one of said lighting fixtures.

2. The lighting balloon apparatus of claim 1, wherein said balloon envelope body is constructed from a medium weight laminate of polyester film weaved into polyester fabric using an adhesive containing an antimicrobial additive and an ultraviolet inhibitor.

3. The lighting balloon apparatus of claim 1, wherein said balloon envelope body is a rectangular shaped body having six orthogonally-fixated sides.

4. The lighting balloon apparatus of claim 3, further comprising at least one reflective material affixed to an interior surface of at least one of said six orthogonally-fixated sides of said balloon envelope body.

5. The lighting balloon apparatus of claim 3, further comprising a means for affixing at least one obstructive article to an exterior surface of at least one of said six orthogonally-fixated sides of said balloon envelope body, said obstructive article being composed of a lightweight material suited for impeding the emission of light.

6. The lighting balloon apparatus of claim 1, further comprising at least one high voltage igniter coupled to said receiving end of at least one of said lighting fixtures, said high voltage igniter receiving said electrical signal transmitted by said power distribution source via said multi-conductor cable to appropriately drive at least one of said plurality of lighting sources coupled to said lighting fixture at a designated power range.

7. The lighting balloon apparatus of claim 6, wherein appropriately driving said lighting fixture at a designated power range of said high voltage igniter is regulated by a step-up transformer coupled to said multi-conductor cable via said power distribution source, wherein said power distribution source is further comprised of a plurality of safety relays configured to determine whether said high voltage igniter is coupled to said power distribution source or is bypassed.

8. The lighting balloon apparatus of claim 6, wherein said high voltage igniter is provided with at least one bypass connector, and wherein said receiving end of said lighting fixture is provided with at least one opposing bypass connector configured to receive said bypass connector of said high voltage igniter.

9. The lighting balloon apparatus of claim 8, wherein when said bypass connector associated with said high voltage igniter is connected to said bypass connector associated with said lighting fixture, said connected high voltage igniter is bypassed and said corresponding connected lighting fixture is powered directly by said electrical signal transmitted by said power distribution source via said multi-conductor cable.

10. The lighting balloon apparatus of claim 1, wherein said at least two different lighting sources having disparate powering requirements and emitting different color temperatures of light are comprised of an HMI bulb and a tungsten bulb.

* * * * *